US012722857B2

(12) United States Patent
Okubo et al.

(10) Patent No.: US 12,722,857 B2
(45) Date of Patent: Sep. 1, 2026

(54) HINGE CAP

(71) Applicant: NIPPON CLOSURES CO., LTD., Tokyo (JP)

(72) Inventors: Yusuke Okubo, Kanagawa (JP); Takashi Sugiyama, Kanagawa (JP); Masaharu Ezaki, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 0 days.

(21) Appl. No.: 18/273,651

(22) PCT Filed: Feb. 9, 2022

(86) PCT No.: PCT/JP2022/005160
§ 371 (c)(1),
(2) Date: Jul. 21, 2023

(87) PCT Pub. No.: WO2022/181342
PCT Pub. Date: Sep. 1, 2022

(65) Prior Publication Data

US 2024/0076106 A1 Mar. 7, 2024

(30) Foreign Application Priority Data

Feb. 26, 2021 (JP) ..... 2021-030240

(51) Int. Cl.
*B65D 47/08* (2006.01)
*B65D 47/36* (2006.01)
*B65D 51/20* (2006.01)

(52) U.S. Cl.
CPC ..... *B65D 47/0838* (2013.01); *B65D 47/36* (2013.01); *B65D 51/20* (2013.01)

(58) Field of Classification Search
CPC .... B65D 47/36; B65D 51/20; B65D 47/0838; B65D 47/08; B65D 47/10; B65D 47/106
See application file for complete search history.

(56) References Cited

U.S. PATENT DOCUMENTS

2019/0185226 A1 6/2019 Sahara et al.

FOREIGN PATENT DOCUMENTS

CN 109803902 5/2019
JP 11-171231 6/1999
(Continued)

OTHER PUBLICATIONS

International Search Report issued Apr. 19, 2022 in International (PCT) Application No. PCT/JP2022/005160.
(Continued)

*Primary Examiner* — Anthony D Stashick
*Assistant Examiner* — L Kmet
(74) *Attorney, Agent, or Firm* — Wenderoth, Lind & Ponack, L.L.P.

(57) ABSTRACT

A hinge cap includes a body and an upper lid connected to each other by a hinge. The body includes a top board and a side wall extending perpendicularly downward from a periphery of the top board. The top board includes a planned opening defined by a weakened portion and a discharge nozzle formed to surround the planned opening. The upper lid includes a top panel and a skirt extending perpendicularly downward from a periphery of the top panel. A protrusion extending in an axial direction of the cap is formed in the planned opening of the body on a side opposite to the hinge such that an end of the protrusion is fixed to an inner surface of the top panel of the upper lid in a closed state.

8 Claims, 3 Drawing Sheets

(56) References Cited

FOREIGN PATENT DOCUMENTS

| | | | | |
|---|---|---|---|---|
| JP | 2012-111535 | | | 6/2012 |
| JP | 2013-71762 | | | 4/2013 |
| JP | 2013-75690 | | | 4/2013 |
| JP | 2013075690 | A | * | 4/2013 |
| JP | 2014-221643 | | | 11/2014 |
| JP | 2015-34012 | | | 2/2015 |
| JP | 2016-43953 | | | 4/2016 |
| JP | 5901198 | B2 | * | 4/2016 |
| JP | 2016043953 | A | * | 4/2016 |
| JP | 2017-171328 | | | 9/2017 |
| JP | 2020055535 | A | * | 4/2020 |
| JP | 2020-97424 | | | 6/2020 |
| JP | 2020-164219 | | | 10/2020 |
| JP | 2020-193028 | | | 12/2020 |

OTHER PUBLICATIONS

Office Action issued Jul. 4, 2025 in corresponding Chinese Patent Application No. 202280016370.7, with English-language translation.

* cited by examiner

HINGE CAP

TECHNICAL FIELD

The present invention relates to a hinge cap with a pull-ring-less mechanism that allows a discharge opening to be formed in a top board of a cap body at the same time as the cap is first opened. More specifically, the present invention relates to a hinge cap that allows a discharge opening to be reliably formed by a first opening operation with less force.

BACKGROUND ART

Hinge caps are widely used on containers for storing liquid like a flavoring material. Such a hinge cap requires the following two-stage operation prior to the first use of the content: First, an upper lid is removed from a cap body; and then a pull ring formed in the cap body is pulled up until it is removed, allowing a weakened portion defining a planned opening to be broken, thereby forming a discharge opening. The content can be discharged only after this operation.

However, such a two-stage opening operation is bothersome and creates a need to dispose of the planned opening that ends up in the garbage after being removed from the cap body. Also, there are such problems that depending on the diameter of a cap, a pull ring is too small for a finger to hook through and that the content may be splashed when the weakened portion is broken by pulling up the pull ring.

In order to solve these problems of hinge caps, a hinge cap without a pull ring has been proposed. For example, Patent Document 1 discloses a hinge cap including a cap body to be attached to a mouth-and-neck portion of a container and an upper lid connected to the cap body by a hinge connection. The cap body includes a ceiling wall and a cylindrical peripheral wall extending perpendicularly downward from the outer circumference of the ceiling wall. The upper lid includes a top wall and a skirt wall extending perpendicularly downward from the outer circumferential edge of the top wall. An upper lid-side locking portion formed at the end of the cylindrical peripheral wall is engaged with a cap body-side locking portion formed to protrude upward from the upper surface of the ceiling wall. The hinge cap includes a spout opening means between the cap body and the upper lid. With the spout opening means, a spout forming rupture portion formed on the ceiling wall, being defined by an endless weakening line, is ripped off from the ceiling wall when the upper lid is opened. The spout opening means includes a connection mechanism for connecting the spout forming rupture portion of the cap body with the inner surface of the ceiling wall of the upper lid, and a delay transfer mechanism for delaying breakage of the endless weakening line so that it occurs at least after the engagement between the cap body-side locking portion and the upper lid-side locking portion on the side opposite to the hinge connection is released upon opening of the upper lid.

Further, Patent Document 2 discloses a resin hinge cap including a cap body to be attached to a container mouth, an upper lid with an upper lid-side engaging portion capable of being engaged with a body side engaging portion of the cap body, and a hinge for hinge-connecting the cap body and the upper lid. By opening the upper lid backward in the front-back direction of the cap body, the engagement between the body side engaging portion and the upper lid-side engaging portion is released, and a weakened portion is broken, thereby allowing the content to be discharged. The cap body includes a discharge guide cylindrical portion and an inner wall that is formed on the inner circumferential side of the discharge guide cylindrical portion and includes a tear-off section defined by the weakened portion. The upper lid includes a tearing-off protrusion joined to the tear-off section. The inner wall includes, on the outer circumferential side of the tear-off section, a front section and a rear section located forward and backward, respectively, of the center of the inner wall in the front-back direction. The inner wall is formed such that the front section is more flexible than the rear section.

PRIOR ART DOCUMENTS

Patent Documents

Patent Document 1: JP-A-2012-111535
Patent Document 2: JP-A-2020-97424

SUMMARY OF THE INVENTION

Problems to be Solved by the Invention

Each of the hinge caps disclosed in the aforementioned patent documents allows a discharge opening to be formed at the same time as the upper lid is removed from the cap body upon first opening of the cap, thus requiring only one action to allow the content to start to be discharged. In addition, since the engagement between the cap body and the upper lid is released at a different point in time from the start of breakage of the weakened portion for forming a discharge opening, the cap can be opened with less force.

However, in Patent Document 1, a welded portion between the upper lid and the planned opening is located away from the weakening line to be broken. As a result, the force for opening the upper lid cannot act efficiently on the weakening line, and thus the cap may not be opened with sufficiently less force.

In Patent Document 2, a welded portion between the upper lid and the planned opening is formed around the whole circumference of the endless weakened portion defining the planned opening. Such a large welded surface creates a great force to inhibit the opening movement of the upper lid. Thus, a further reduction in the first opening force is desired.

In view of the above, the present inventors proposed a hinge cap including a protrusion extending perpendicularly downward in the axial direction from the inner surface of a top panel of an upper lid (JP-A-2020-180761). The protrusion is formed such that the end of the protrusion is fixed to a planned opening on the side opposite to a hinge. This hinge cap allows a discharge opening to be reliably formed by a first opening operation and achieves a reduction in the first opening force.

However, it was found that the end of the protrusion, which is located near a weakened portion defining the planned opening, could damage the weakened portion depending on the way it is fixed.

In light of the above, an object of the present invention is to provide a hinge cap that is molded such that a weakened portion is effectively prevented from being damaged, and has a pull-ring-less mechanism that allows a discharge opening to be reliably formed with a force at approximately the same level as required by a hinge cap with a pull ring.

Means for Solving the Problems

The present invention provides a hinge cap including a body and an upper lid connected to each other by a hinge.

The body includes a top board and a side wall extending perpendicularly downward from a periphery of the top board. The top board includes a planned opening defined by a weakened portion and a discharge nozzle formed to surround the planned opening. The upper lid includes a top panel and a skirt extending perpendicularly downward from a periphery of the top panel. A protrusion extending in an axial direction of the cap is formed in the planned opening of the body on a side opposite to the hinge such that an end of the protrusion is fixed to an inner surface of the top panel of the upper lid in a closed state.

It is suitable for the hinge cap of the present invention that:

1. The upper lid includes an annular wall capable of receiving the end of the protrusion so that the end of the protrusion is fixed in the annular wall of the upper lid in a closed state;
2. The top board of the body includes an inclined surface that is inclined downward in the axial direction of the cap from a hinge side to a discharge direction side;
3. The planned opening is shaped such that it decreases in perpendicular distance to a discharge direction toward the discharge direction and has an acute angle at its end on the discharge direction side;
4. A tongue piece protruding radially outward and obliquely downward is formed on the hinge side of a lower surface of the planned opening;
5. The protrusion is hollow;
6. The end of the protrusion is fixed to the upper lid by being welded to the inner surface of the upper lid; and
7. A second protrusion is formed adjacent to the hinge side of the protrusion in the planned opening such that an end of the second protrusion does not come into contact with the inner surface of the upper lid in a closed state.

Effect of the Invention

According to the hinge cap of the present invention, a fixed portion where a closed upper lid and a cap body are fixed to each other is formed on the inner surface of the upper lid. Thus, when the fixed portion is formed by welding or the like, a weakened portion defining a planned opening can be prevented from being damaged. As a result, the weakened portion is effectively prevented from being accidentally broken before the formation of an opening by a user.

Further, a protrusion extending axially from the planned opening is formed on the side opposite to a hinge (on the discharge direction side). Thus, the opening force created by the upper lid pivoting about the hinge can act efficiently on the weakened portion, resulting in a reduction in the first opening force. Breakage of the weakened portion requires the greatest force at the beginning. If the fixed portion is formed around the whole circumference of the endless weakened portion as described above, the opening force of the upper lid is distributed across the whole fixed portion and, thus, cannot act efficiently on the starting point of breakage. Further, if the fixed portion is formed also on the hinge side, the opening operation of the upper lid is inhibited by a force created by this fixed portion even after the weakened portion is broken from the content discharge direction side, resulting in a failure to achieve a sufficient reduction in the opening force. In contrast, when the fixed portion is formed only on the discharge direction side, it is possible to concentrate stress at the end of the weakened portion on the discharge direction side when the opening operation of the upper lid is started. Further, once the weakened portion starts to be broken, the breakage of the weakened portion can proceed efficiently because the point of breakage of the weakened portion is not subjected to the inhibitory force as mentioned above.

According to the hinge cap of the present invention, the fixed portion is formed away from the planned opening. Thus, a top board of the cap body including the planned opening can be inclined toward the discharge direction. As a result, great stress can act efficiently on the breakage start part of the weakened portion, resulting in a reduction in the first opening force.

Further, the protrusion is formed on the discharge direction side of the planned opening, while no side wall is formed in other parts of the planned opening. This improves flexibility of the planned opening and, thus, allows the pivoting movement of the upper lid to be initiated at a different point in time from breakage of the weakened portion upon first opening of the cap. As a result, the opening force can be reduced.

Furthermore, the planned opening is shaped such that the end on the discharge direction side of the planned opening, i.e., the starting point of breakage of the weakened portion, has an acute angle. This facilitates crack propagation from the starting point of breakage of the weakened portion to the hinge, resulting in a further reduction in the opening force.

MODE FOR CARRYING OUT THE INVENTION

Figure 1:
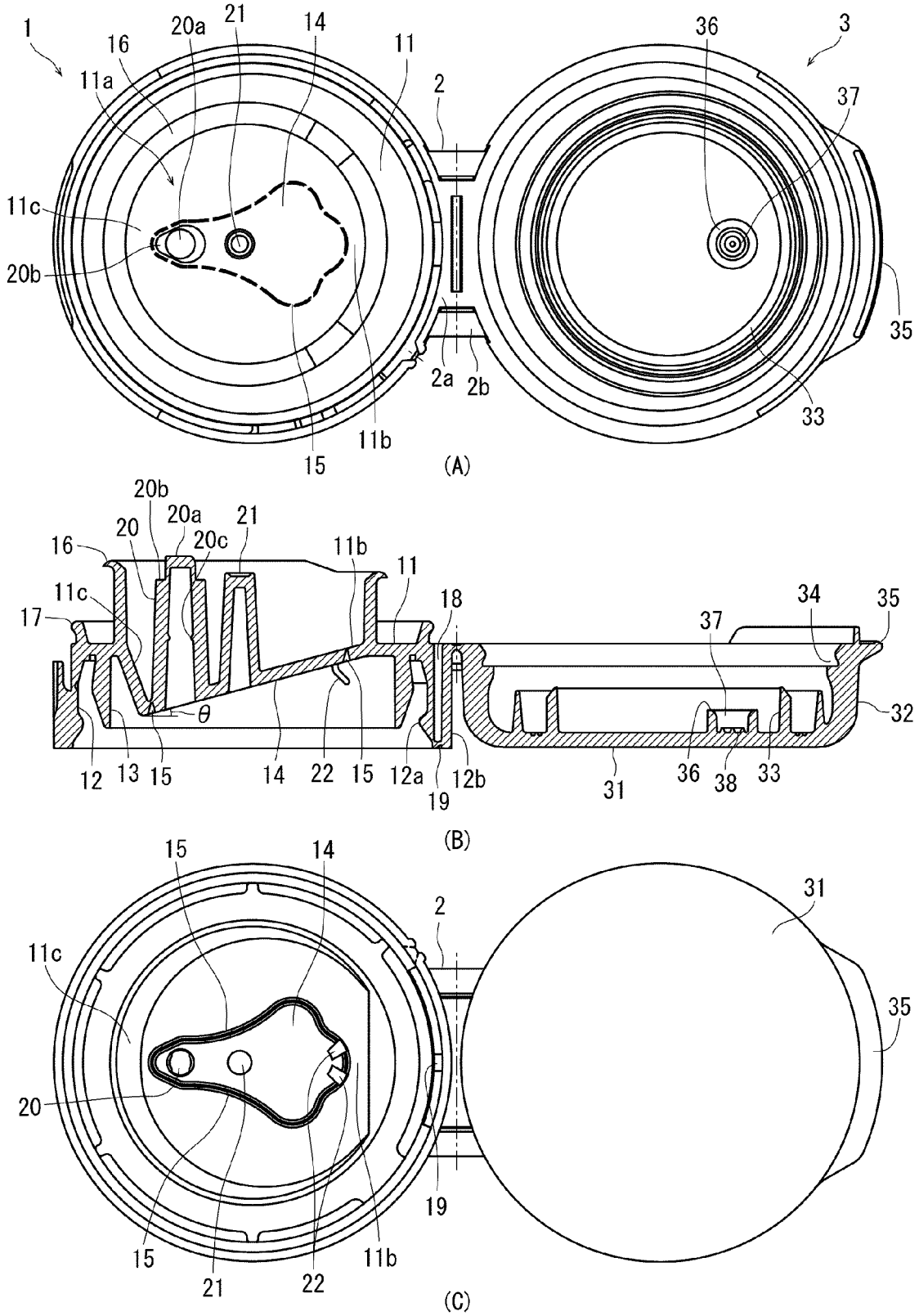
FIG. 1: a view showing an example of a hinge cap of the present invention before an upper lid and a cap body are fixed to each other; (A), (B) and (C) in FIG. 1 are a top view, a sectional side view, and a bottom view, respectively.

The hinge cap of the present invention will be described with reference to the attached drawings.

The hinge cap of the present invention shown in FIGS. 1 to 5 includes a cap body 1 and an upper lid 3 connected to the cap body 1 by a hinge (a hinge connection 2). The cap body 1 schematically includes a top board 11 and a cylindrical side wall 12 extending perpendicularly downward from the peripheral edge of the top board 11.

In the illustrated specific example, an inner ring 13 extending downward is formed on the inner surface of the top board 11 away from the cylindrical side wall 12, as is evident from FIG. 1(B). The cap body 1 is attached to a container mouth (not shown) by allowing the container mouth to fit in a space formed between the inner ring 13 and the cylindrical side wall 12.

Further, a planned opening 14, which will serve as an opening through which the content is taken out, is integrally formed with the top board 11 via an endless weakened portion 15. When the planned opening 14 is ripped off by tearing the weakened portion 15, the planned opening 14 serves as a discharge opening (denoted by A in FIG. 4). The planned opening 14 will be described later.

On the upper surface side of the top board 11, a discharge nozzle 16 is formed to surround the planned opening 14. The content is guided along the discharge nozzle 16 when taken out through the opening A formed in the top board 11. The discharge nozzle 16 is formed to be lower on the side of the hinge connection 2 with the upper lid 3. On the outer side of the discharge nozzle 16, a low circumferential convexity 17 is formed to hold the upper lid 3.

The cylindrical side wall 12 of the cap body 11 partially has a double-walled structure in which the side wall is divided into an inner side wall 12*a* and an outer side wall 12*b* by an arc-shaped slit 18 extending downward from the upper end such that the inner side wall 12*a* and the outer side wall 12*b* are connected through a circumferential score 19 at the lower end. The double-walled structure is formed to facilitate removal of the cap body 1 from the container mouth after the content fluid in the container has been discharged.

The upper lid 3, on the other hand, is hinge-connected to an upper end part of the cylindrical side wall 12 (outer side wall 12*b* formed by the slit 18) of the cap body 1. As can be understood from FIG. 1, the hinge connection 2 includes a wide band 2*a* in the center and narrow bands 2*b*, 2*b* on both sides of the wide band in the circumferential direction.

Although not shown in the drawings, an axial score is formed on the outer wall 12*b* in the vicinity of the hinge connection 2 to extend from the upper end to the lower end or its vicinity of the outer wall. Thus, when the upper lid 3 in an open state is pulled downward, the axial score is torn, allowing the outer wall 12*b* to be broken. Then, the upper lid is forced in the counterclockwise direction (when seen in the top view of FIG. 1(A)), thereby breaking the circumferential score 19. As a result, the cap body 1 can be easily removed from the container mouth. Such means for removing the hinge cap from the container mouth is known per se as described in detail in JP-A-2018-058622, for example.

Figure 2:
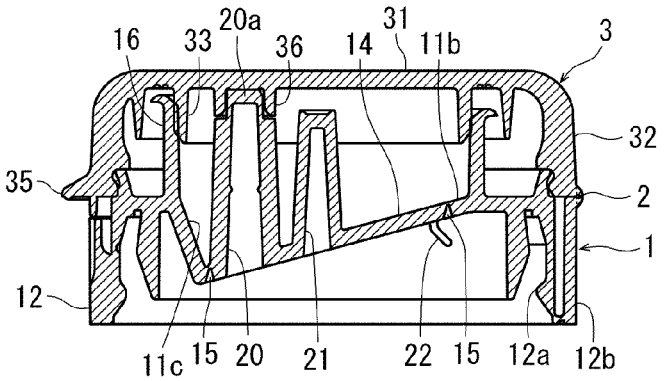
FIG. 2: a sectional side view of the hinge cap shown in FIG. 1 with the upper lid fixed to the cap body.
Figure 3:
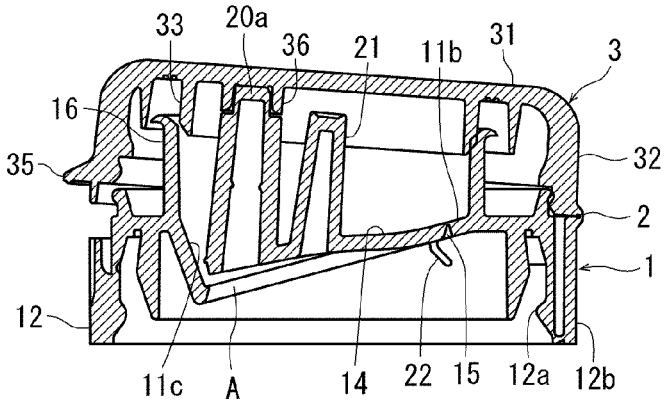
FIG. 3: a sectional side view of the hinge cap shown in FIG. 2 that starts to be opened.

The upper lid 3 includes a top plate 31 and a skirt 32 extending from the periphery of the top plate 31. On the inner surface of the top plate 31, a circumferential sealing projection 33 is formed. As shown in FIG. 2, when the upper lid 3 pivots about the hinge 2 to be closed, the circumferential sealing projection 33 adheres tightly to the inner surface of the discharge nozzle 16, thereby ensuring sealability after the discharge opening A has been formed by ripping off the planned opening 14.

In a lower part of the inner surface of the skirt 32 of the upper lid 3, a concavity 34 is formed, which is engaged with the upper end of the circumferential convexity 17 to maintain the closed upper lid 3 stably.

At the lower end of the outer surface of the skirt of the upper lid 3, an opening flange 35 is provided on the side opposite to the hinge connection 2. The upper lid 3 can be opened easily by being lifted upward with a finger hooked under the flange 35.

The top plate 31 of the upper lid 3 includes an annular wall 36 that is capable of receiving the tip of the protrusion 20 (to be described below) formed in the planned opening 14 of the cap body 1. The annular wall 36 will be described later.

An important feature of the present invention is that the protrusion 20 extending in the axial direction of the cap is formed on the side opposite to the hinge 2 (on the discharge direction side) in the planned opening 14 in the top board 11 of the cap body and that a tip 20*a* of the protrusion 20 is fixed to the inner surface of the top plate 31 of the upper lid 3 in a closed state.

The protrusion 20 has a hollow circular truncated cone shape with a stepped portion 20*b* formed in the vicinity of the tip 20*a*. As is evident from FIG. 2, the lateral surface of the tip 20*a* comes close to (or abuts) the inner circumferential surface of the annular wall 36 of the upper lid 3 to be described later, and the upper surface of the tip 20*a* abuts the inner surface of the top plate 31 of the upper lid 3. In this manner, the tip 20*a* is received in a concavity 37 defined by the annular wall 36. In the illustrated specific example, a minute projection 38 concentric with the annular wall 36 is further formed in the concavity 37 of the upper lid 3. This increases the welding surface, resulting in stronger welding to the upper surface of the tip 20*a*.

Further, a second protrusion 21 is formed adjacent to the hinge side of the protrusion 20. The second protrusion extends in the axial direction of the cap such that the end of the second protrusion does not come into contact with the inner surface of the upper lid 3 in a closed state. The second protrusion 21 serves to cushion the impact caused when the protrusion 20 comes into contact with the top plate 31 of the upper lid 3, thereby preventing accidental breakage of the weakened portion.

Both the protrusion 20 and the second protrusion 21 suitably have a hollow circular truncated cone shape to prevent a decrease in dimensional stability due to sink marks during resin molding. In the illustrated specific example, an annular ridge 20*c* is formed at approximately the midpoint of the axial height of the hollow inner surface of the protrusion 20. During molding of the cap, a pin is inserted in the hollow part of the protrusion. If the pin sticks to the protrusion, the weakened portion may be broken when the pin is removed. The annular ridge 20*c* can effectively prevent such breakage of the weakened portion.

In the illustrated specific example, a top board portion 11*a* including the planned opening 14 in the discharge nozzle 16 is inclined downward in the axial direction of the cap from the hinge connection 2 side to the discharge direction side at an acute angle θ to the horizontal direction of the cap. With this structure, the first opening force due to the pivoting movement acts in a direction forming the acute angle to the planned opening, so that the weakening line can be broken smoothly, resulting in a reduction in the first opening force. The acute angle θ is preferably in a range of 10 to 20 degrees. If the acute angle θ is larger than the range, it may be difficult to adjust the discharge of the content. On the other hand, if the acute angle θ is smaller than the range, there is less benefit in making the planned opening inclined.

Along with the inclined top board portion 11*a* in the discharge nozzle 16, the top board 11 has an inclined surface 11*c* that is inclined obliquely downward from the discharge direction side of the discharge nozzle 16 to the planned opening 14. With this structure, the content can be discharged smoothly.

On the hinge side of the lower surface of the planned opening 14, two tongue pieces 22, 22 are formed to protrude radially outward and obliquely downward. The function of the tongue piece 22 will be described later.

The hinge cap of the present invention is molded with the upper lid 3 opened as shown in FIG. 1. Then, the upper lid 3 is closed, allowing the tip 20*a* of the protrusion 20 to be received in the concavity 37 in the annular wall 36 of the upper lid 3, followed by heating such as high-frequency induction heating. As a result, the tip 20*a* of the protrusion 20 and the inner surface of the top panel of the upper lid 3 are fixed to each other on the discharge direction side (FIG. 2).

Since the tip 20*a* of the protrusion 20 is fixed in the concavity 37 in the annular wall 36, the protrusion 20 is stably secured to the upper lid 3. Thus, when the upper lid 3 is first opened, an opening can be formed easily without causing the protrusion 20 to fall. Also, there is another advantage that even if resin powder is produced when the protrusion tip is welded to the upper lid, the resin powder is prevented from penetrating into the cap.

Figure 6:
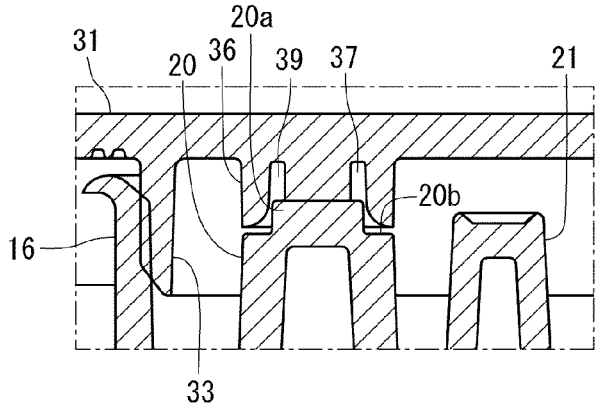
FIG. 6: a partially enlarged sectional view showing another embodiment of a fixed portion of the hinge cap of the present invention.

As described above, the minute projection 38 concentric with the annular wall 36 is formed in the concavity 37 defined by the annular wall 36 of the upper lid 3. Alternatively, a minute protuberance 39 as shown in FIG. 6 may be provided such that the lower surface of the minute protuberance 39 is fixed to the upper surface of the tip 20*a*.

The cap is first opened as follows: The upper lid 3 in a closed state as shown in FIG. 2 pivots about the hinge 2, so that the weakened portion 15 connecting the planned opening 14 with the top board 11 starts to be broken from the discharge direction side of the planned opening 14 (FIG. 3); and as the upper lid 3 continues to pivot further, the planned opening 14, which is integrated with the upper lid 3, is completely ripped off from the top board 11, thereby forming an opening as the discharge opening A (FIG. 4).

Figure 4:
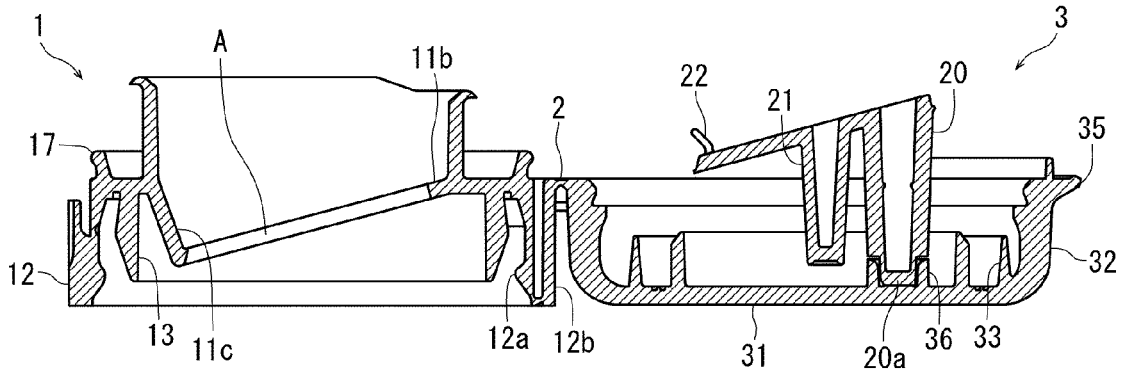
FIG. 4: a sectional side view of the hinge cap shown in FIG. 2 that is completely opened.
Figure 5:
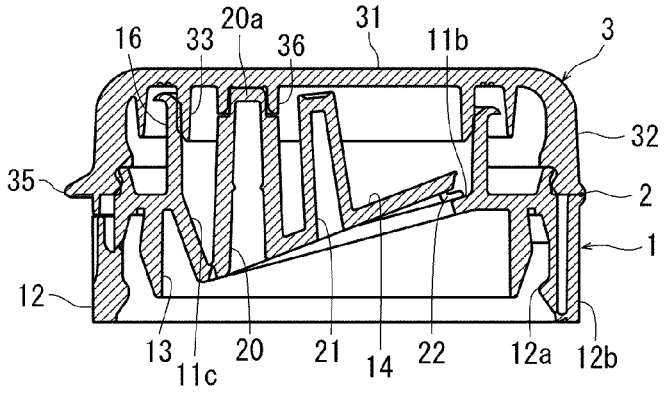
FIG. 5: a sectional side view of the hinge cap shown in FIG. 4 that is resealed with the upper lid engaged with the cap body.

When the opened cap body 1 as shown in FIG. 4 is resealed with the upper lid 3, the tongue piece 22 formed on the lower surface of the planned opening 14 as described above is locked to the upper surface of a hinge-side top board portion 11*b* in the discharge nozzle, thereby preventing the hinge side of the planned opening 14 from being engaged with the lower surface of the top board portion 11*b* (FIG. 5). If the hinge side of the planned opening 14 is engaged with the lower surface of the hinge-side top board portion 11*b*, the content may be splashed when the cap is reopened by the impact of releasing the engagement. To avoid this, the tongue piece 22 capable of being locked to the upper surface of the hinge-side top board portion 11*b* is formed on the lower surface of the planned opening 14, thereby preventing the aforementioned impact upon opening of the cap.

According to the hinge cap of the present invention, the planned opening 14 formed in the cap body is suitably shaped such that it decreases in perpendicular distance to the discharge direction toward the discharge direction and has an acute angle at its end on the discharge direction side, as shown in the drawings. The thus-shaped planned opening makes it possible, upon first opening of the cap, to concentrate stress at the end on the discharge direction side where the protrusion 20 is formed, whereby breakage of the weakened portion starts smoothly. Further, the acute angle formed at the end on the discharge direction side makes it possible to easily adjust the amount of discharge of the content.

Further, as shown in the illustrated specific example, the planned opening suitably has an approximately drop shape that decreases in perpendicular distance also at the end on the hinge side toward the end on the hinge side. This shape makes it possible to smoothly remove the planned opening 14 from the top board 11, resulting in effective prevention of a splash of the content, and the like.

The planned opening can have any of various shapes as long as it has an acute angle at the end on the discharge direction side. Examples of the shape include, but are not limited to, the illustrated approximately drop shape, an approximately spindle shape, an approximately four-leaf shape, an approximately three-leaf shape, and a diamond shape.

In the illustrated specific example, the planned opening is inclined toward the discharge direction side, thereby reducing the first opening force as described above. Alternatively, the top board of the cap body may not have an inclined surface. In such a case, a thin-walled portion can be formed on the lower surface of the top board of the cap body and the discharge direction side of the planned opening. This makes the top board more flexible on the discharge direction side. Thus, upon opening of the upper lid, the discharge direction side of the top board is bent, so that breakage of the weakened portion is delayed to start after the engagement between the upper lid and the cap body is released, resulting in a reduction in the opening force.

In the present invention, the discharge opening A can be formed by opening the upper lid 3 without need for a pull ring. Thus, the discharge opening A can be formed easily even in a small-diameter cap. The present invention is not limited to the illustrated cap to be attached to a container mouth. The same effect can also be achieved by applying the present invention to, for example, a lidded spout including: a spout body including a base to be welded and fixed to a pouch-type container body and a plug body with an internal passage connected with the base; and a lid molded integrally with the plug body via a hinge so that an opening at the end of the internal passage of the plug body can be opened and closed.

More specifically, a planned opening defined by a weakened portion is formed on a closed end surface of the internal passage of the plug body of the spout. A protrusion is formed on the inner surface side of a top panel of the lid. In a state where the lid is placed on the plug body, the lower end of the protrusion is fixed to the planned opening. With this structure, the weakened portion is broken at the same time as the lid is first opened, and the planned opening, which is integrated with the lid, is removed from the plug body, thereby forming a discharge opening.

The hinge cap of the present invention can be produced by injection molding or the like in the following manner: The upper lid in an open state as shown in FIG. 1 is formed integrally with the cap body: and then the upper lid is closed, so that the protrusion is fixed to the planned opening. The hollow circular truncated cone shape of the protrusion facilitates easy integral molding of the upper lid and the cap body.

The upper lid and the cap body may be of any material as long as they can be integrally molded and the protrusion can be fixed to the upper lid. In view of the fact that the upper lid and the cap body are suitably welded together by high-frequency heating or heat sealing, they are suitably formed of a hot melt thermoplastic resin.

Suitable examples of the thermoplastic resin include olefin-based resins such as polypropylene and polyethylene.

EXPLANATIONS OF LETTERS OR NUMERALS

1: Cap body
2: Hinge
3: Upper lid
11: Top board
12: Cylindrical side wall
13: Inner ring
14: Planned opening
15: Weakened portion
16: Discharge nozzle

17: Circumferential convexity
18: Slit
19: Circumferential score
20: Protrusion
21: Second protrusion
22: Tongue piece
31: Top plate
32: Skirt
33: Circumferential projection
34: Concavity
35: Flange
36: Annular wall
37: Concavity
38: Minute projection

The invention claimed is:

1. A hinge cap comprising a body and an upper lid connected to each other by a hinge, wherein the body includes a top board and a side wall extending perpendicularly downward from a periphery of the top board, the top board including a planned opening defined by a weakened portion and a discharge nozzle formed to surround the planned opening, the upper lid includes a top panel and a skirt extending perpendicularly downward from a periphery of the top panel, a protrusion extending in an axial direction of the hinge cap is formed in the planned opening of the body on a side opposite to the hinge such that an end of the protrusion is fixed to an inner surface of the top panel of the upper lid in a closed state, the weakened portion is lower in the axial direction of the hinge cap on the side opposite to the hinge than on a hinge side, the top board of the body includes a first inclined surface that is inclined downward in the axial direction of the hinge cap from the hinge side to the side opposite to the hinge at an acute angle to a horizontal direction of the hinge cap, and the top board includes a second inclined surface that is inclined downward from a lower end of the discharge nozzle on the side opposite to the hinge to the planned opening, and the planned opening is formed on the first inclined surface of the top board.

2. The hinge cap according to claim 1, wherein the upper lid further includes an annular wall capable of receiving the end of the protrusion so that the end of the protrusion is fixed in the annular wall of the upper lid in the closed state.

3. The hinge cap according to claim 1, wherein the planned opening is shaped such that the planned opening decreases in distance, in a direction that is perpendicular to a direction that connects the hinge and the side opposite to the hinge, from the hinge side toward the side opposite to the hinge and has an acute angle at an end on the side opposite to the hinge.

4. The hinge cap according to claim 1, wherein a tongue piece protruding radially outward and obliquely downward is formed on the hinge side of a lower surface of the planned opening.

5. The hinge cap according to claim 1, wherein the protrusion is hollow.

6. The hinge cap according to claim 1, wherein the end of the protrusion is fixed to the upper lid by being welded to the inner surface of the upper lid.

7. The hinge cap according to claim 1, wherein a second protrusion is formed adjacent to the hinge side of the protrusion in the planned opening such that an end of the second protrusion does not come into contact with the inner surface of the upper lid in the closed state.

8. A hinge cap comprising a body and an upper lid connected to each other by a hinge, wherein the body includes a top board and a side wall extending perpendicularly downward from a periphery of the top board, the top board including a planned opening defined by a weakened portion and a discharge nozzle formed to surround the planned opening, the upper lid includes a top panel and a skirt extending perpendicularly downward from a periphery of the top panel, a protrusion extending in an axial direction of the hinge cap is formed in the planned opening of the body on a side opposite to the hinge such that an end of the protrusion is fixed to an inner surface of the top panel of the upper lid in a closed state, the weakened portion is lower in the axial direction of the hinge cap on the side opposite to the hinge than on a hinge side, the top board of the body includes an inclined surface that is inclined downward in the axial direction of the hinge cap from the hinge side to the side opposite to the hinge at an acute angle to a horizontal direction of the hinge cap, the planned opening is formed on the inclined surface, and a tongue piece protruding radially outward and obliquely downward is formed on the hinge side of a lower surface of the planned opening.

* * * * *